US008038017B2

(12) United States Patent
Close

(10) Patent No.: US 8,038,017 B2
(45) Date of Patent: Oct. 18, 2011

(54) SPRING DRIVEN METHOD AND APPARATUS FOR IN-CARTON DISPLAY AND FRONTING OF MERCHANDISE ITEMS

(75) Inventor: James Garth Close, Georgetown, TX (US)

(73) Assignee: Close in Solutions, LLC, Austin, TX (US)

( * ) Notice: Subject to any disclaimer, the term of this patent is extended or adjusted under 35 U.S.C. 154(b) by 295 days.

(21) Appl. No.: 11/623,397

(22) Filed: Jan. 16, 2007

(65) Prior Publication Data

US 2007/0194037 A1 Aug. 23, 2007

Related U.S. Application Data

(60) Provisional application No. 60/758,398, filed on Jan. 13, 2006, provisional application No. 60/774,943, filed on Feb. 21, 2006, provisional application No. 60/761,857, filed on Jan. 25, 2006, provisional application No. 60/839,317, filed on Aug. 23, 2006.

(51) Int. Cl.
*A47F 1/04* (2006.01)

(52) U.S. Cl. ..... 211/59.3; 211/119.005; 221/197; 221/198; 206/774; 206/526; 206/817

(58) Field of Classification Search ..... 211/59.3, 211/59.2, 184, 72, 126.1, 126.16, 133.6, 211/119.005; 312/61, 71; 221/197, 198; 206/774, 526, 817, 804, 556
See application file for complete search history.

(56) References Cited

U.S. PATENT DOCUMENTS

| | | | | |
|---|---|---|---|---|
| 2,563,078 | A * | 8/1951 | Silberman | 126/299 C |
| 5,634,564 | A * | 6/1997 | Spamer et al. | 211/59.3 |
| 6,129,218 | A * | 10/2000 | Henry et al. | 211/59.3 |
| 6,454,107 | B1 * | 9/2002 | Belanger et al. | 211/59.3 |
| 6,666,533 | B1 * | 12/2003 | Stavros | 312/348.3 |
| 6,769,552 | B1 * | 8/2004 | Thalenfeld | 211/59.3 |
| 6,886,699 | B2 * | 5/2005 | Johnson et al. | 211/59.3 |
| 6,964,235 | B2 * | 11/2005 | Hardy | 108/61 |
| 7,168,579 | B2 * | 1/2007 | Richter et al. | 211/59.3 |
| 7,201,281 | B1 * | 4/2007 | Welker | 211/59.3 |
| 7,249,703 | B2 * | 7/2007 | Leapman | 229/800 |
| 2001/0010302 | A1 * | 8/2001 | Nickerson | 211/59.3 |
| 2004/0000528 | A1 * | 1/2004 | Nagel | 211/59.3 |
| 2004/0099721 | A1 * | 5/2004 | Leapman | 229/122.1 |
| 2004/0140279 | A1 * | 7/2004 | Mueller et al. | 211/59.3 |
| 2004/0222282 | A1 * | 11/2004 | Drees | 229/800 |
| 2005/0049579 | A1 * | 3/2005 | Shedlov et al. | 606/1 |
| 2005/0178788 | A1 * | 8/2005 | Shannon et al. | 221/199 |
| 2006/0060547 | A1 * | 3/2006 | Chang | 211/73 |

FOREIGN PATENT DOCUMENTS

EP 0987971 B1 2/1999

* cited by examiner

*Primary Examiner* — Darnell Jayne
*Assistant Examiner* — Devin Barnett

(57) ABSTRACT

A spring alignment mechanism utilizes a guide inserted into a display carton below merchandise items. A spring-driven rear pull member travels on the guide so that as items are removed from the carton, remaining items are pulled forward. In one example, the guide is inserted between the bottom of merchandise items and the carton bottom. In another example, merchandise items are supported on cardboard support rails built into the bottom of the carton, or provided on a carton insert; and the guide is inserted between the cardboard support rails.

5 Claims, 15 Drawing Sheets

101
120
124
126
134
139
143
144
151
152
1D
1E

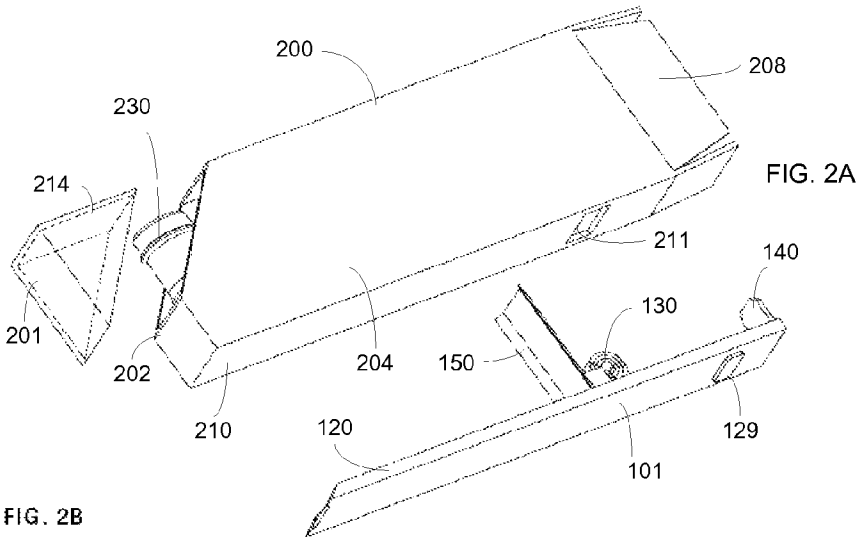
FIG. 2A
FIG. 2B
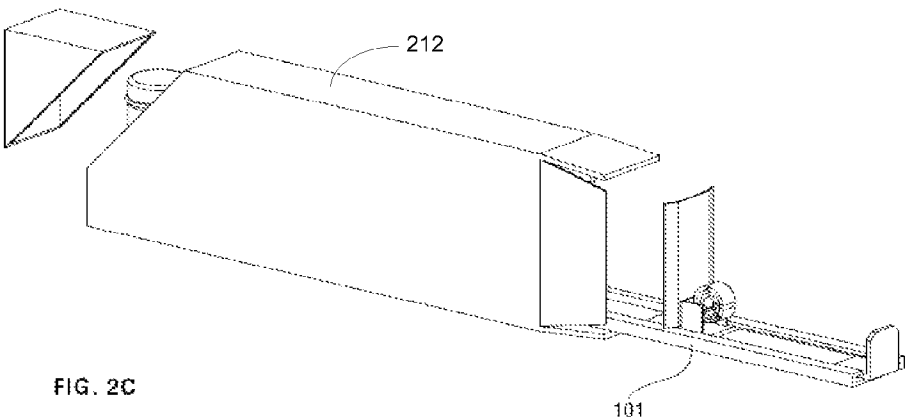
FIG. 2C

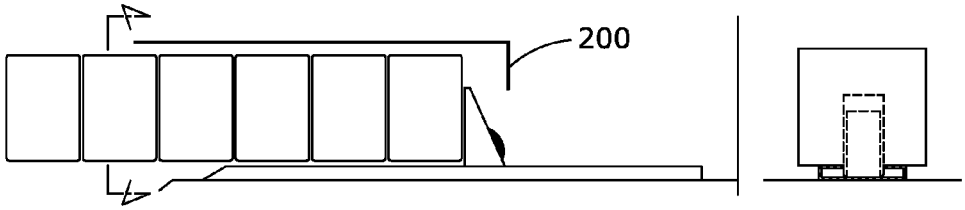
FIG. 7A
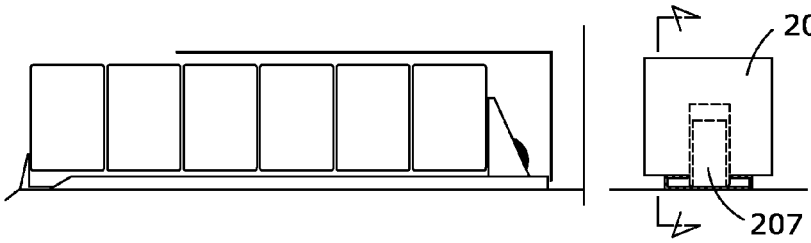
FIG. 7B
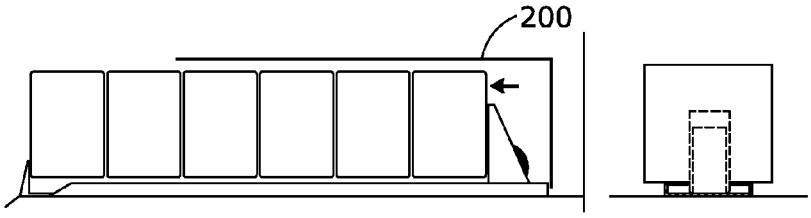
FIG. 7C
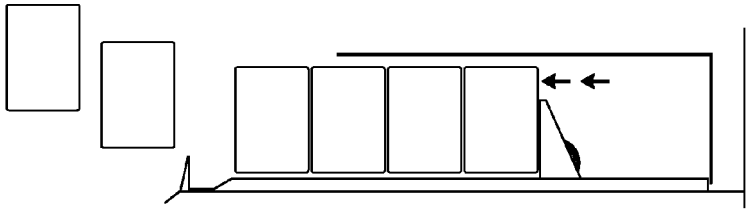

FIG. 9C
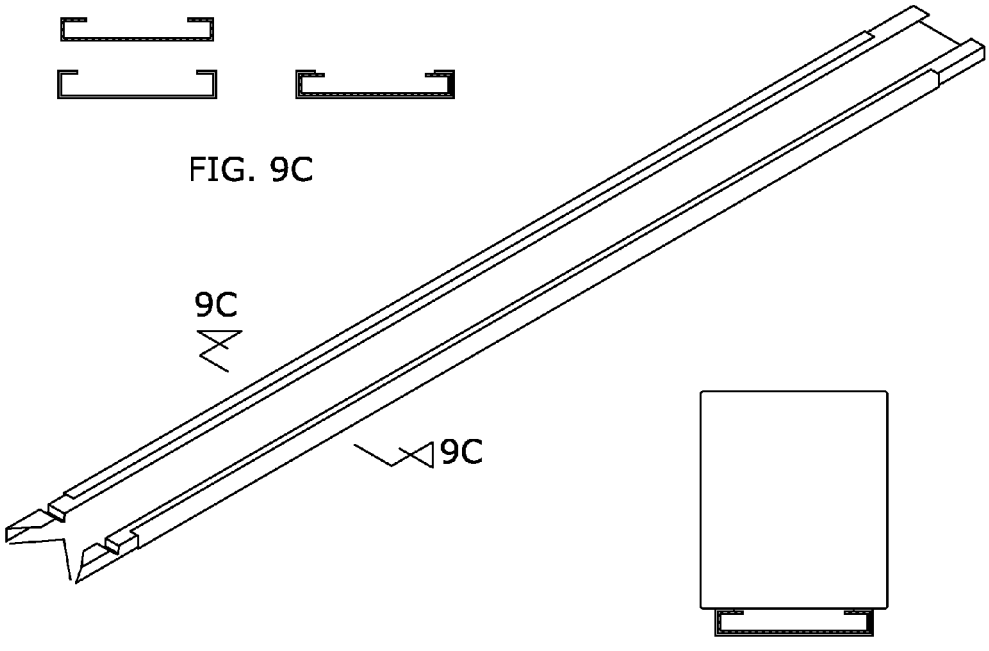
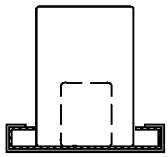
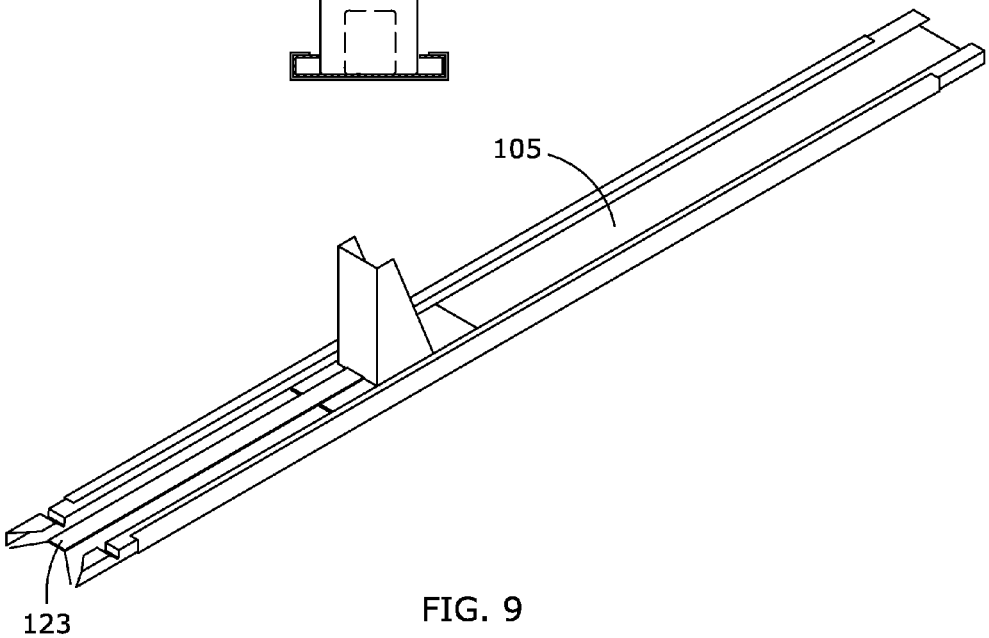
FIG. 9

SPRING DRIVEN METHOD AND APPARATUS FOR IN-CARTON DISPLAY AND FRONTING OF MERCHANDISE ITEMS

RELATED APPLICATIONS

This application is related to Provisional Application No. 60/758,398 filed Jan. 13, 2006 for "Carton with spring pusher" and Provisional Application No. 60/774,943 filed Feb. 21, 2006 for "QSTIK™"—a system for auto fronting items in a store", No. 60/761,857 filed Jan. 25, 2006 for "QSTIK" inventory and display control", and Provisional Application No. 60/839,317 filed Aug. 23, 2006, and claims priority from those provisional applications.

BACKGROUND OF INVENTION

The invention relates to the in-carton display of products such as those packaged in bottles, jars, cans, pouches, envelopes, and boxes, and more particularly to devices and methods in which products displayed in a carton can easily be moved forward by a spring driven device for improved visual exposure and effortless selection by consumers.

BACKGROUND OF INVENTION

Retail stores relying on the consumers to serve themselves have recognized the importance of displaying products near the front edge of display cartons so that the products can be readily seen by consumers and easily reached by the customers. Customers typically remove products from the front of a carton, and products remaining toward the rear of the carton may be difficult to see or to reach. This problem is aggravated by the increasing use of in-carton displays where sales may be lost if products are not visible from the front of the carton. In order to compensate for the difficulty in seeing products at the rear of a display carton or seeing those products that have fallen over to the bottom of a carton, manufactures have adopted the use of relatively short cartons, where each carton may be only a fraction of the shelf depth.

As more products are merchandised directly from cartons, there is a need for product alignment devices which provide automatic alignment of items in a display carton. It is desirable to provide effective display in a single long carton, rather than several shorter cartons. The longer cartons reduce packaging costs and retail labor.

Suppliers are using small shipper boxes to try to keep pouched products from falling into the box and disappearing from the customer's eye. The small boxes are an inefficient solution, because they require repetitive printing, and they are often lost on the shelf behind other boxes creating poor sales and inventory problems. The small boxes can not keep the product well fronted past the first few pouches.

Grocery and discount stores are cutting costs by requiring suppliers to display their products in the same shipper boxes in which the product arrived at the store, and it is desirable to provide a solution that permits effective shipment and display.

SUMMARY OF THE INVENTION

The current invention relates to a device, system and method for displaying and automatically re-aligning products in a display carton. The current invention includes various embodiments of the QSTIK™ system for in-box merchandising and fronting. The system and methods typically use a spring to drive pull members along a guide to automatically front items in a display carton. In some embodiments, the guide is inserted into a carton either before the carton is shipped or at a retail location. In other embodiments, the guide is secured to a display shelf, and the carton is inserted onto the guide. The guide is typically inserted into the rear or bottom of a carton in a manner that a pull member engages the rearmost item container in the carton and pushes a row of items forward as an item is removed from the front of the carton by a customer.

In one embodiment of the current invention, a carton of multiple merchandise item containers, such as product pouches, bottles, cans, or boxes, is automatically aligned with a spring alignment mechanism which provides a pressure to pull or push remaining item containers forward in the display carton as items are removed by customers.

In another embodiment, a standard shipping or display carton is modified to permit removal of a portion of the carton bottom or rear in order to insert the alignment device. In one embodiment, the carton is modified to provide product support rails to elevate the items off of the bottom of the carton. In one embodiment, the carton is modified to permit removal of a small portion of the bottom of the carton in order to provide an anchoring slot for the alignment device.

In another embodiment, items in containers such as cans, bottles, and boxes are shipped so that the containers rest on a disposable spring alignment mechanism which is part of the package. In one embodiment, a support means such as cardboard rails are provided with the carton so that the rails hold the items in an elevated position relative to the carton bottom. A spring alignment device is positioned in the space between the rails—below the product items and above the carton bottom.

DESCRIPTION OF FIGURES

FIG. 2A is a side perspective view of a merchandise carton 200.

FIG. 2B is a side perspective view of one embodiment of an assembled spring alignment device to be inserted into the carton of FIG. 2A.

FIG. 2C shows the spring alignment device 101 of FIG. 2B partially inserted into the carton 200 of FIG. 2A.

FIG. 7A is a side view of a carton partially inserted over an alignment device guide.

FIG. 7B is a rear view of the carton and alignment device.

FIG. 7C is a side view showing the carton dropped in place over the alignment device.

FIG. 9 is a top perspective view of a metal alignment device which has a front end including tapered sides and a recessed area for attaching a spring hook.

DETAILED DESCRIPTION OF EMBODIMENT

Spring Alignment Mechanism

In one embodiment of the current invention, multiple merchandise item containers, such as product pouches, are shipped to a retailer in a carton. The carton is intended to be used for merchandise display, so that the retailer is not required to remove the merchandise items from the carton, such as to place the merchandise items on a display shelf. The retailer inserts a spring alignment mechanism into the carton, so that the spring alignment mechanism provides a pressure to pull remaining merchandise items forward in the display carton as merchandise items are removed from the carton by customers.

In this manner, the spring acts on a rear pull member to pull remaining items forward as items are removed from the display carton. This application permits the use of a longer carton than what might typically be used in a grocery application. One reason that relatively short cartons are used in many applications is to prevent a situation where items removed were out of view of a potential customer. By pulling items forward packaging cost maybe reduced by permitting units to be shipped and displayed in a carton which corresponds to the shelf depth.

In other embodiments, the spring alignment mechanism device may be positioned in the carton at the time that the carton is shipped, so that the device is active at the time that the carton is opened for display.

Spring Alignment Device

Figures 1A, 1B, 1F:
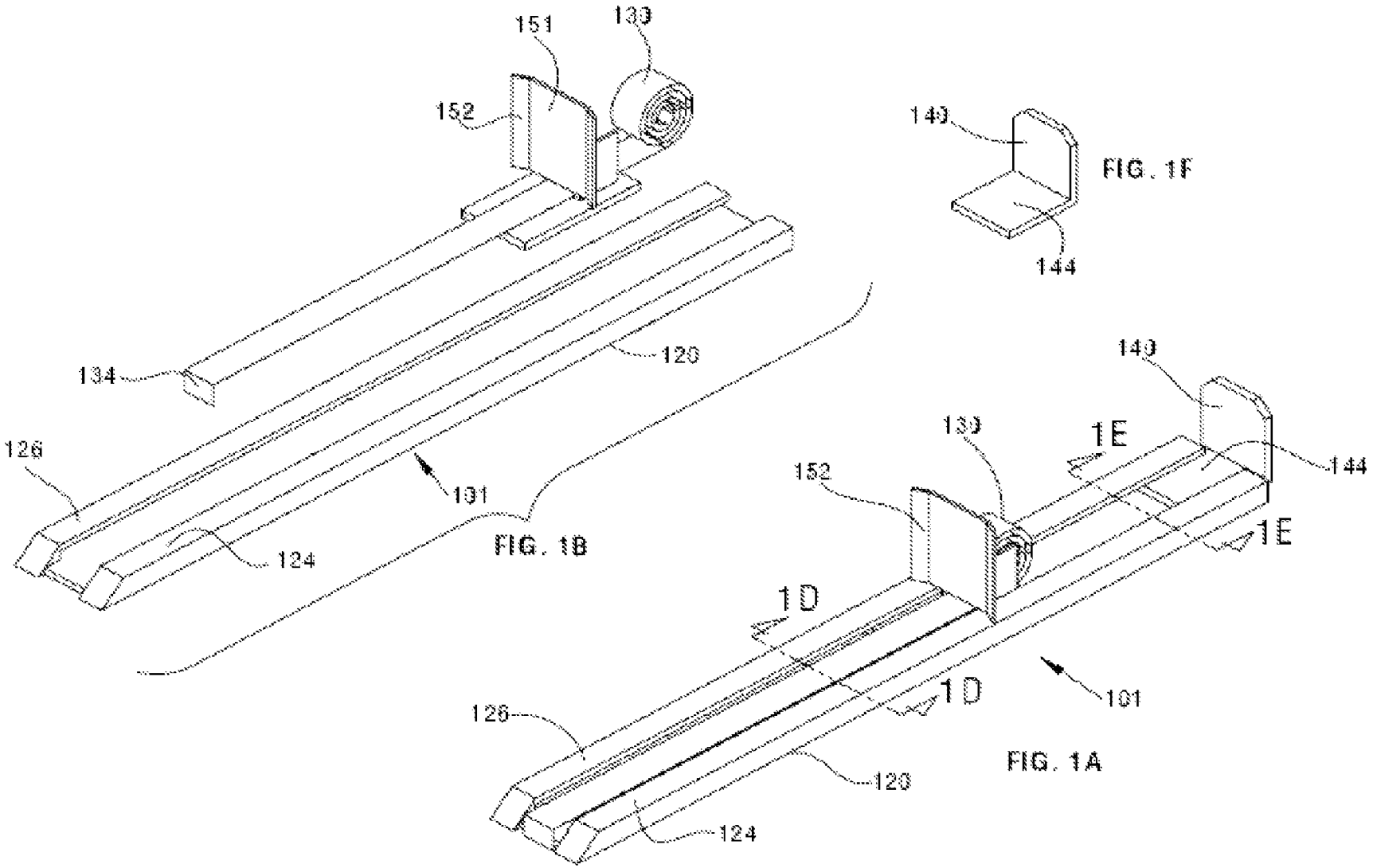
FIG. 1A is a front perspective view of one embodiment of an assembled spring alignment device 101 with a guide 120, a spring 130, a handle 140, and a rear pull member 150.
FIG. 1B is a front perspective view of the guide 120 of FIG. 1A.
FIG. 1F is a front perspective view of the handle 140 of FIG. 1A.

FIG. 1A is a front perspective view of one embodiment of an assembled spring alignment device 101 with a guide 120, a spring 130, a handle 140, and a rear pull member 150.

Guide

FIG. 1B is a front perspective view of the guide 120 of FIG. 1A showing a tapered front edge 122, a first side rail 124, a second side rail 126 and a rear end 127.

Rear Pull Member

Figure 1C:
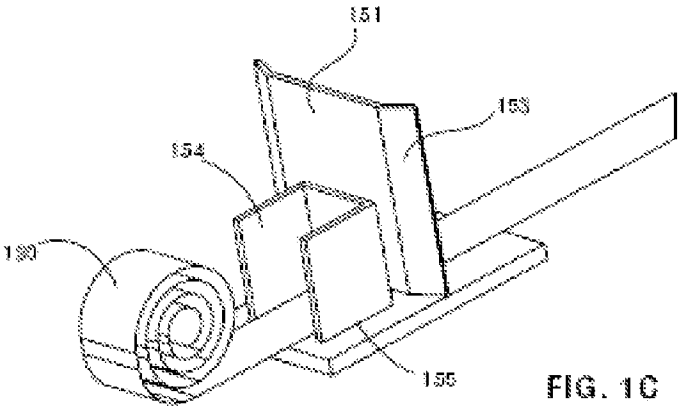
FIG. 1C is a side view of the spring 130, and the rear pull member 150 of the guide 120 of FIG. 1A.

FIG. 1C is a side view of the spring 130, and the rear pull member 150 of the guide 120 of FIG. 1A. In this example, the rear pull member includes a pull plate 151, first side extension 152, a second side extension 153, and a spring retention element 154. In other examples, the rear pull member may be a single plate, frame, looped wire, or other element which engages merchandise items as discussed below. In this example, the spring 130 has a first end 132 which is attached in proximity to the front edge of the guide as shown in FIG. 1A. The first end of the spring is bent in order to form a hook 134 which may engage the front edge of the guide between the first side rail 124, and the second side rail 126. The spring also includes a coiled portion 136 which acts on the rear pull member.

Figure 1E:
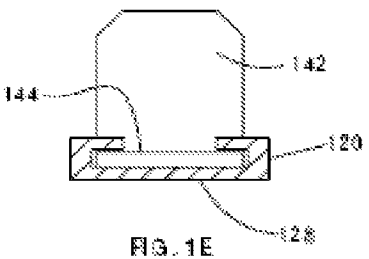
FIG. 1E is a cross section view of the guide of FIG. 1B.
Figure 1D:
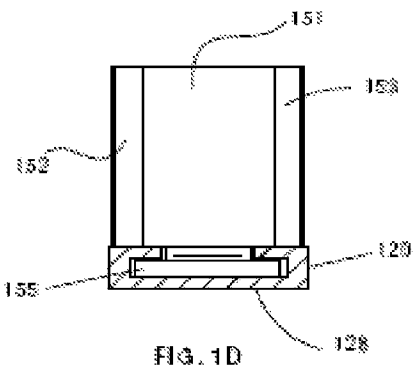
FIG. 1D is a front view of the rear pull member 150 of the guide 120 of FIG. 1A.

FIG. 1D is a front view of the rear pull member 150 of the guide 120 of FIG. 1A showing a pull plate 151, first side extension 152, a second side extension 153, and a base 155. In this example, the base 155 slides along the guide 120 between the first side rail 124 and the second side rail 126. In other embodiments, the coiled portion of the spring may serve as a rear pull member without a separate pull plate.

FIG. 1E is a cross section view of the guide of FIG. 1B showing a bottom portion 128, a first side rail 124, and a second side rail 126. In this example, the side rails are each open channels which serve to contain the base 155 of the rear pull member. FIG. 1F is a front perspective view of the handle 140 of FIG. 1A showing an upright portion 142 and a base portion 144, where the base portion is inserted between a first side rail 124 and the second side rail 126 at the rear end 127 of the guide 120. In the example, the handle serves as a rear stop for the rear pull member. In other examples, the alignment device may be provided without a handle. The alignment mechanism may have scribed partition marks, such as at 1" intervals, in the rear of the guide to permit the guide to snapped off or cut to a desired length for a particular carton length or shelf width.

Spring Alignment Mechanism Inserted into Carton of Items

FIG. 2A is a side perspective view of a merchandise carton 200 having a front portion 201, a front end 202, a first side 204, a second side 206, a rear end 208, a bottom 210, and a top 212. In this example, a portion 214 of the front end 201 has been removed to expose merchandise items 230. In this example, the merchandise items are spice bottles. FIG. 2B is a side perspective view of one embodiment of an assembled spring alignment device 101 with a guide 120, spring 130, handle 140, and rear pull member 150. In this example, the guide includes an anchor 129 which engages an anchor slot 211 in the bottom 210 of the carton. In this example, the anchor slot was removed from the carton, such as with perforations. In other examples, the carton may be provided with the slot. In this example, the rear of the cartoon has been opened to permit insertion of the spring alignment device 101. In other examples, only a portion of the rear of the carton may be removed or opened in order to insert an alignment device.

Advantages of the alignment device include improved ease of installation, an approach that can be used with most items in a supermarket, reduced labor costs from the elimination of item handling, and shelf space savings.

FIG. 2C shows the spring alignment device 101 of FIG. 2B partially inserted into the carton 200 of FIG. 2A.

Figure 2D:
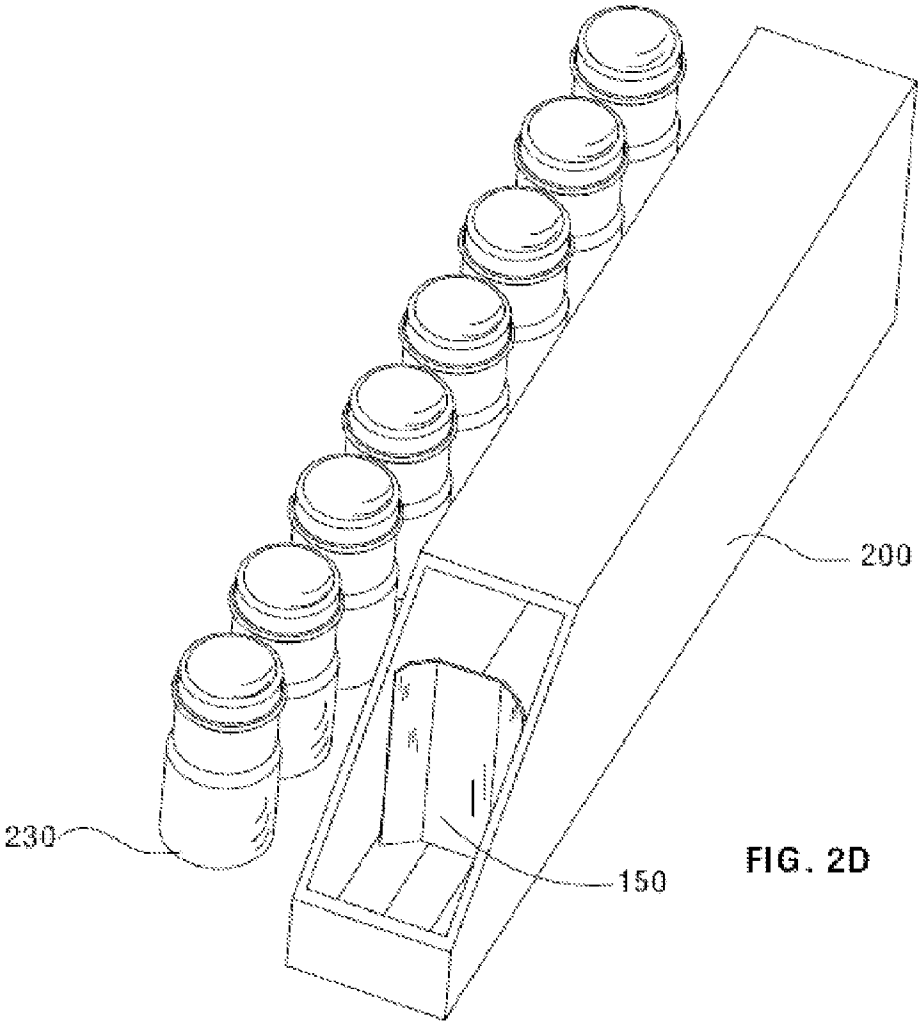
FIG. 2D shows plurality of merchandise items 230 removed from the carton 200, and the rear pull member 150 pushed near the front of the carton 200.

FIG. 2D shows plurality of merchandise items 230 removed from the carton 200, and the rear pull member 150 pushed near the front of the carton 200. In this example, the merchandise items have rounded bottoms and alignment device can be pushed underneath the items, so it is not necessary to support the merchandise items on carton rails in order to insert the alignment device underneath the items. In other examples as discussed below, the merchandise items are supported by a pair of rails or other features in the bottom of the carton so that the alignment device may easily be inserted under the items.

Spring Alignment Mechanism Inserted on Spacer Insert

Figure 3A:
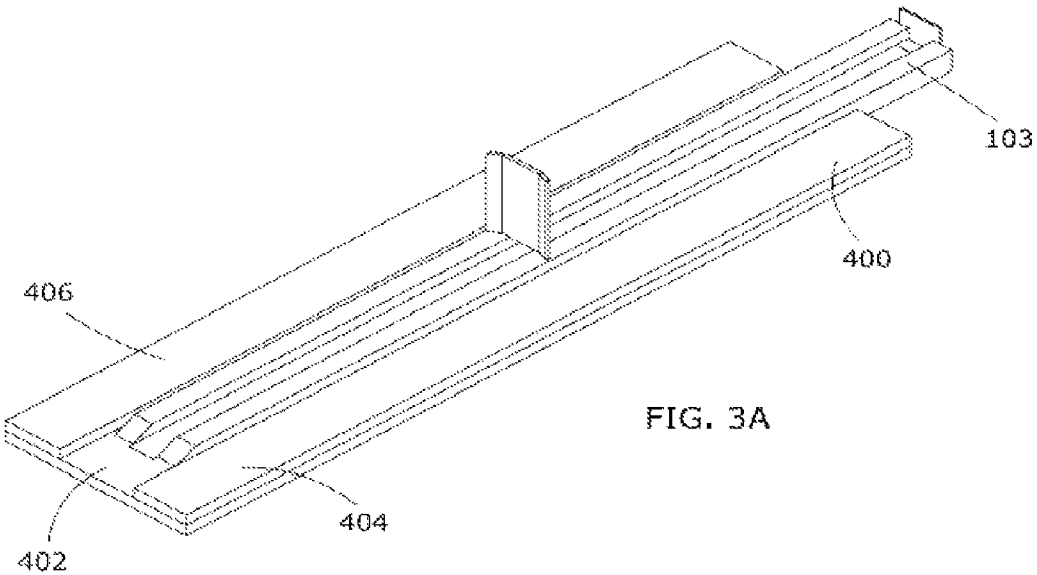
FIG. 3A shows a side top perspective view of an alignment device 103 on a spacer insert 400.
Figure 3B:
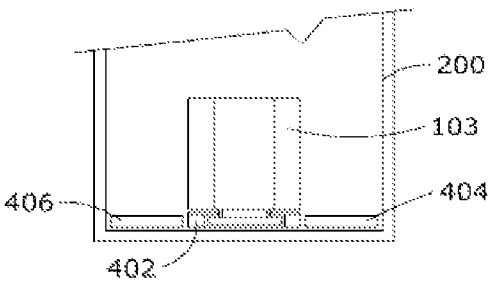
FIG. 3B is a front view of the alignment device, the spacer insert 400, and a carton 200.
Figure 3C:
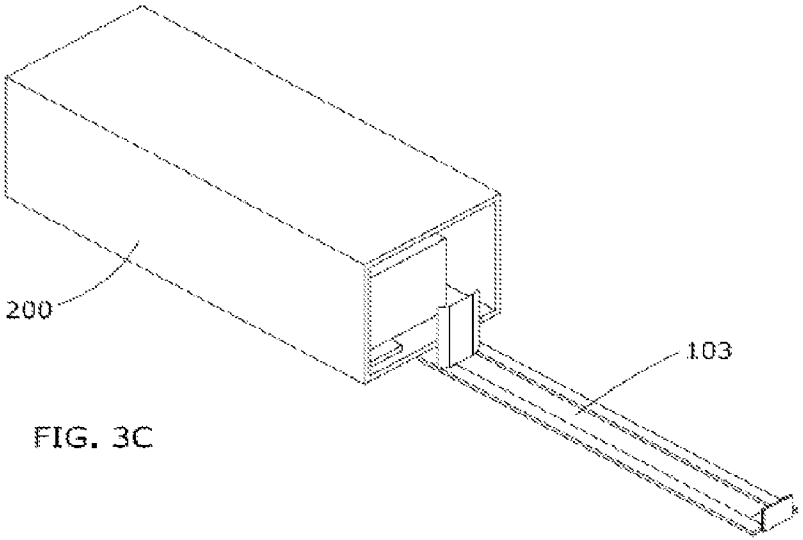
FIG. 3C is a rear perspective view of an alignment device partially inserted into the rear of a carton with a spacer insert 400.
Figure 3D:
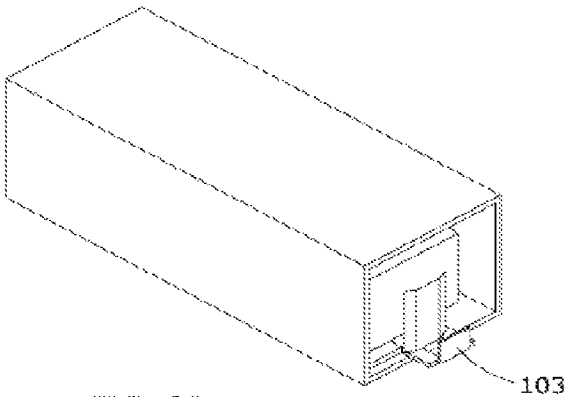
FIG. 3D is a rear perspective view of the alignment device inserted into the rear of the carton.

FIG. 3A shows a side top perspective view of an alignment device 103 on a spacer insert 400. In this example, the spacer insert is designed to be inserted into the bottom of a carton before merchandise items are placed in the carton. The spacer includes a bottom portion 402, a first elevated side support 404, and a second elevated side support 406. In this example, the elevated side supports are slightly taller than the alignment device guide so that the guide may easily be inserted under the merchandise items 230. FIG. 3B is a front view of the alignment device, the spacer insert 400, and a carton 200. FIG. 3C is a rear perspective view of an alignment device partially inserted into the rear of a carton with a spacer insert 400, and merchandise items 230. FIG. 3D is a rear perspective view of the alignment device inserted into the rear of the carton. The spacer insert is typically fabricate from cardboard, but may be formed of a plastic or other material.

Spring Alignment Mechanism Attached to Display Shelf

Figure 4A:
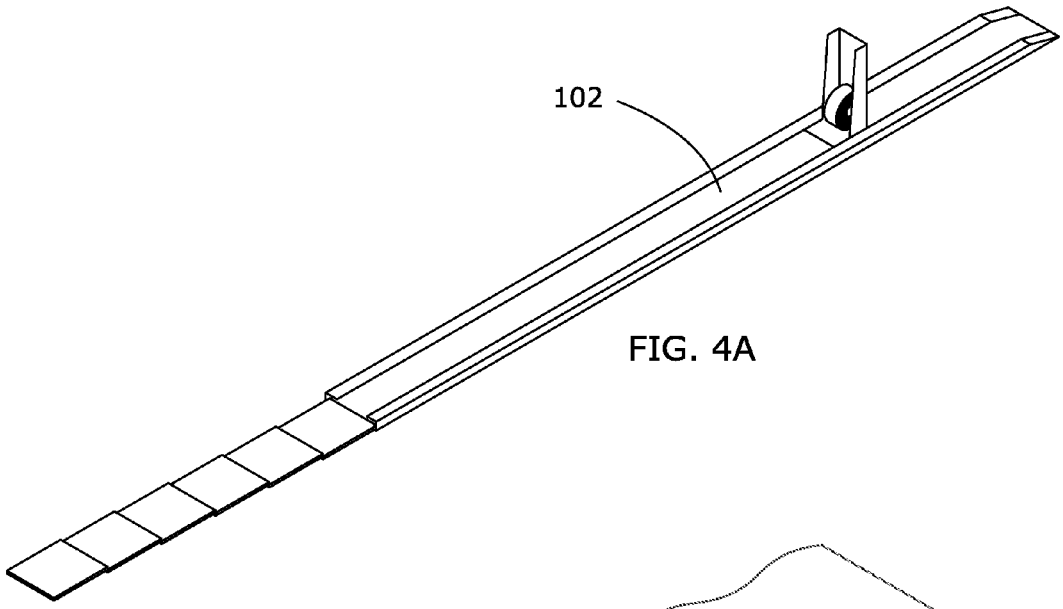
FIG. 4A is a top perspective view of an alignment device 102.

FIG. 4A is a top perspective view of an alignment device 102.

Figure 4B:
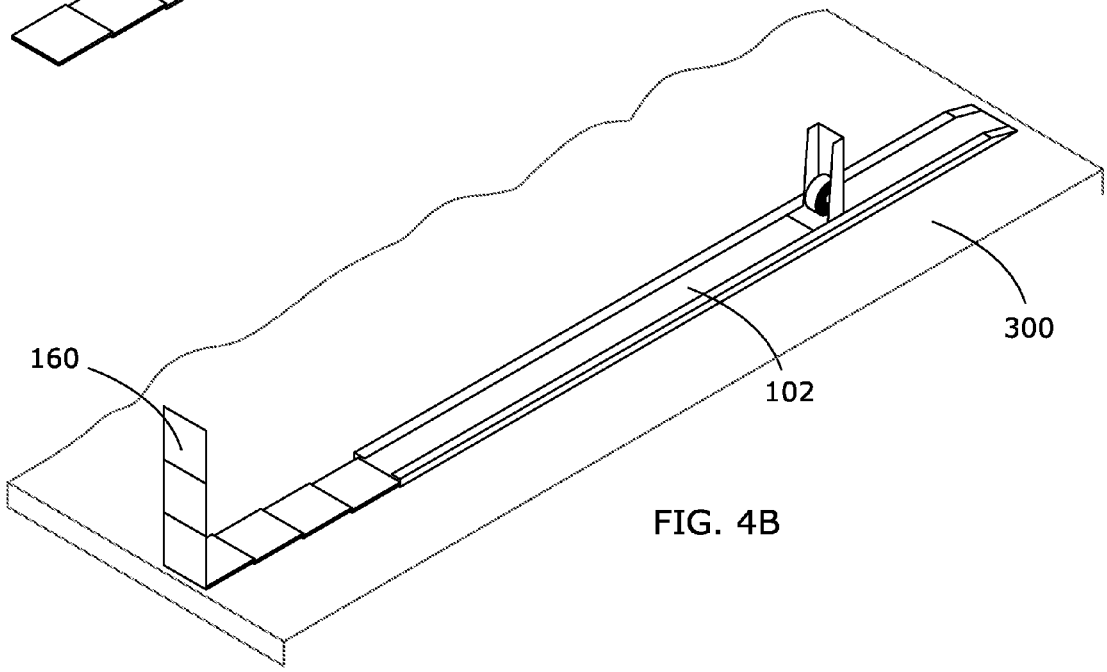
FIG. 4B is a top perspective view of the alignment device 102 placed on a display shelf 300.

FIG. 4B is a top perspective view of the alignment device 102 placed on a display shelf 300.

Figure 4C:
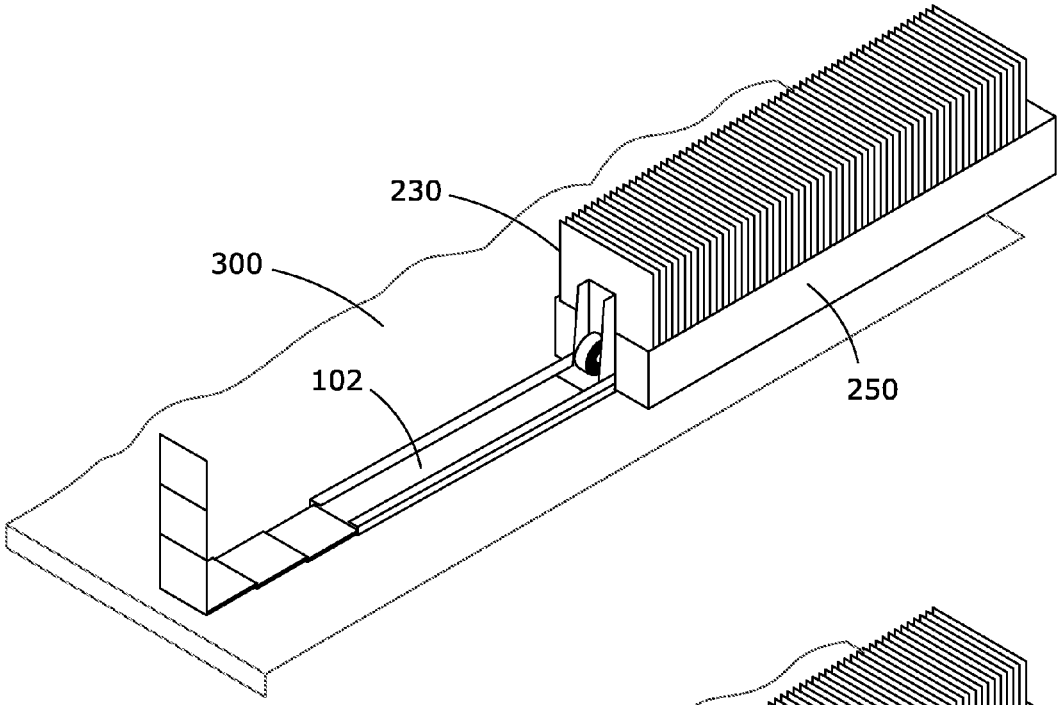
FIG. 4C is a top rear perspective view of a tray 250 of merchandise items 230 partially inserted over the alignment device 102 of FIG. 4B.

FIG. 4C is a top rear perspective view of a tray 250 of merchandise items 230 partially inserted over an alignment device 102 which is affixed to a display shelf 300. In this example, the alignment device 102 includes a magnetic attachment element 160 which attaches to a metallic shelf. In this example, the handle is replaced with the magnetic attachment element 160. In other examples, adhesives, tape, or mechanical attachment means may be used to removably secure the guide to a display shelf, or the guides may be built into the shelf. In this example, the merchandise items are pouches. As the tray is pushed onto the alignment device, the pouches are restrained by the front of the tray, and the pouches force the rear pull member backwards along the guide. In other examples the merchandise items may be boxes, jars, cans, other containers, or unpackaged items. The alignment device assists in the proper placement of cartons on a display shelf. In another example, the rear portion 121 of the alignment device may be partially scribed so that it can be bent to a desired shelf width so that the bent rear portion serves as a rear stop for the rear pull member.

Figure 4D:
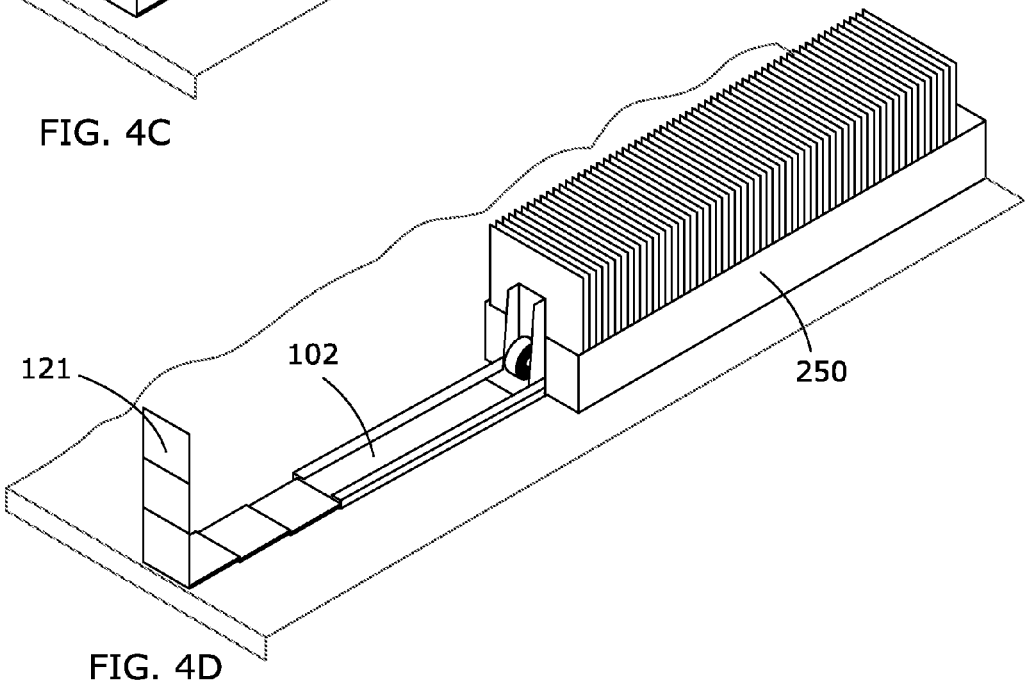
FIG. 4D is a top rear perspective view of the tray 250 of merchandise items 230 inserted further over the alignment device 102.

FIG. 4D is a top rear perspective view of the tray 250 of merchandise items 230 inserted further over the alignment device 102.

Figure 5A:
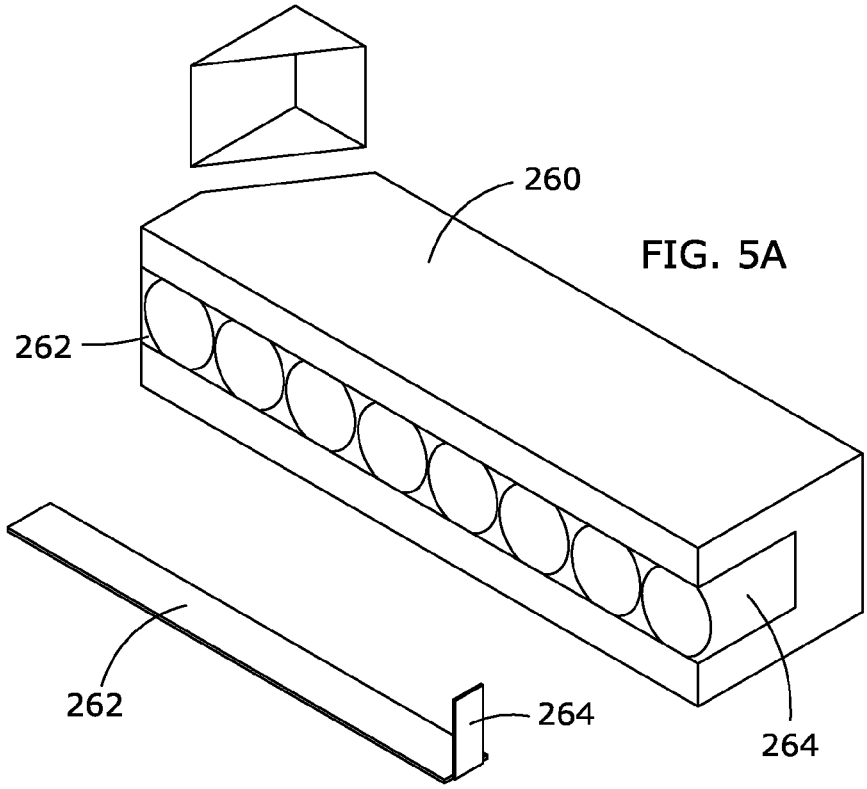
FIG. 5A is a side perspective view of a carton 260 with a removable bottom slot 262 and removable rear slot 264 for insertion over an alignment device attached to a display shelf.

FIG. 5A is a side perspective view of a carton 260 with a removable bottom slot 262 and removable rear slot 264. In this example, the retailer may remove the bottom slot and the rear slot, and then slide the carton over an alignment device which is attached to a display shelf. The alignment device may be attached by a variety of attachment means including an adhesive, with double side tape, magnetically, or mechanically. In this example, the carton contains a plurality of product pouches 232.

Figure 5B:
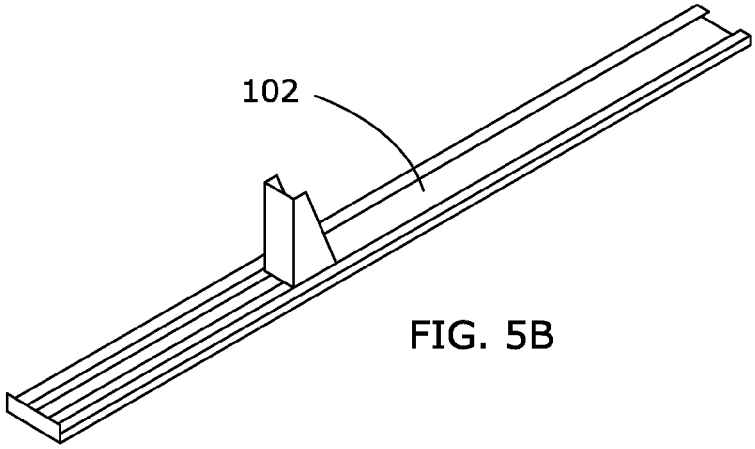
FIG. 5B is a front perspective view of an alignment device 102.
Figures 5C, 5D:
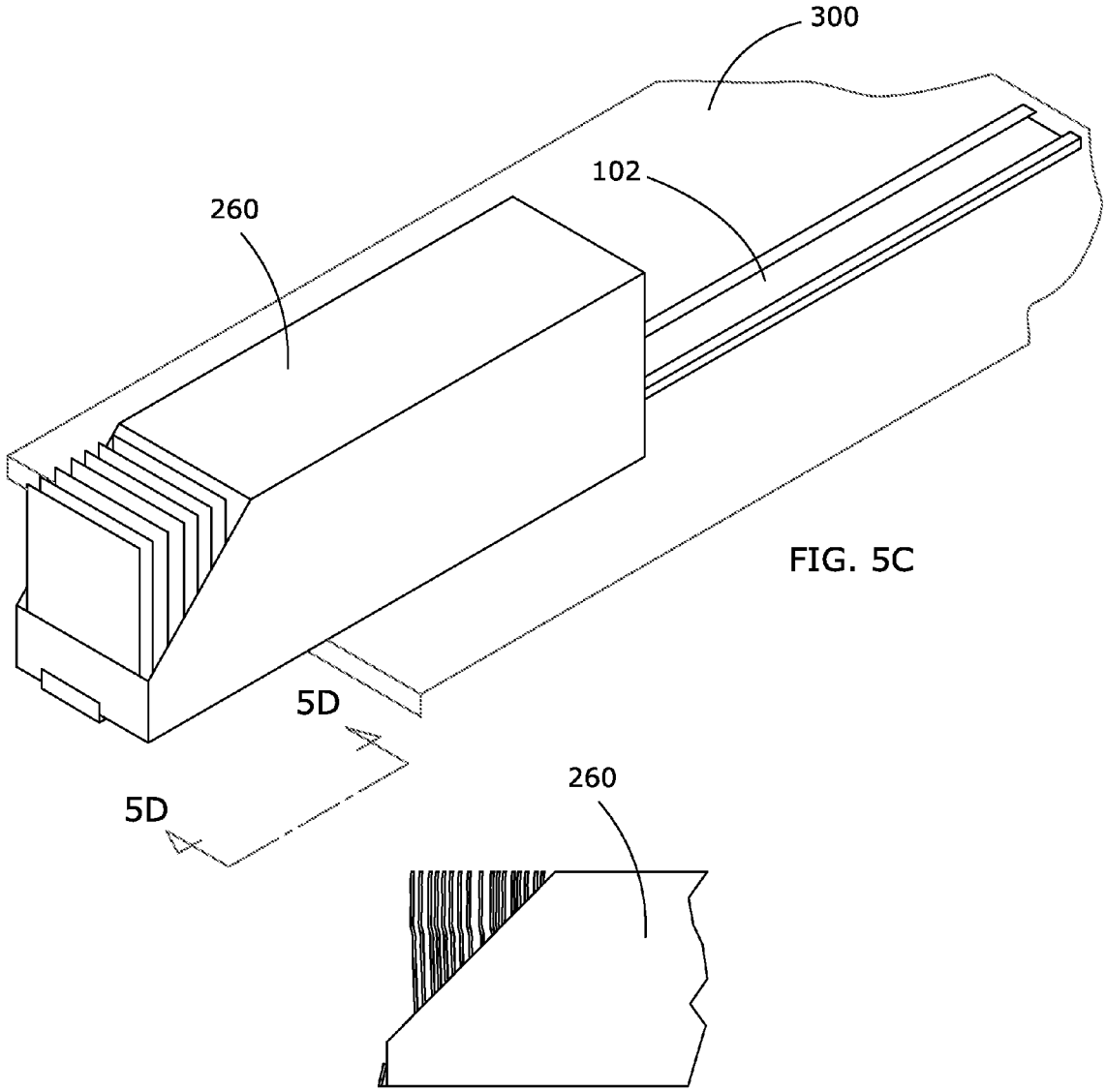
FIG. 5C is a front perspective view of the carton 260 of FIG. 5A partially inserted over the alignment device 102 of FIG. 5B.

FIG. 5B is a front perspective view of an alignment device 102. FIG. 5C is a front perspective view of the carton 260 of FIG. 5A partially inserted over the alignment device 102 of FIG. 5B.

Figure 6A:
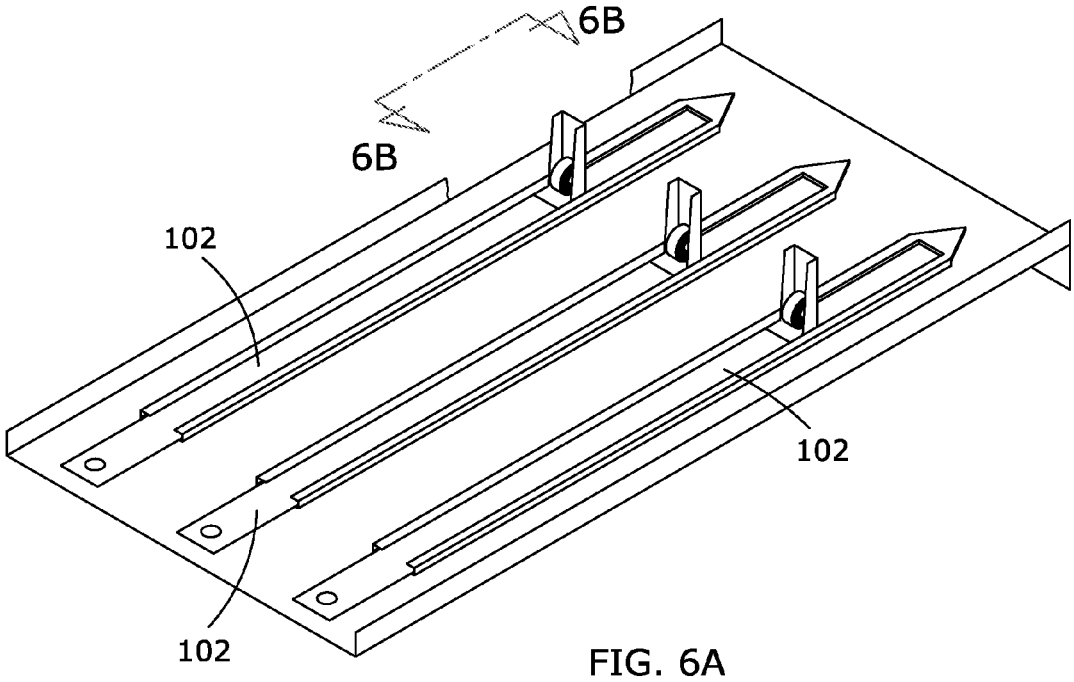
FIG. 6A is a front perspective view of several alignment devices 102 positioned on a display shelf 300.
Figure 6B:
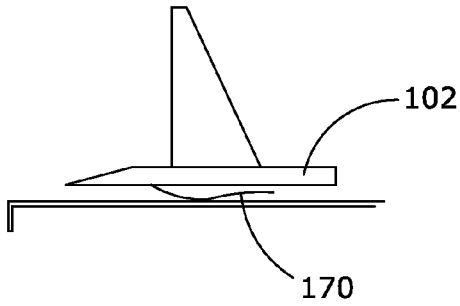
FIG. 6B is a side view of the front portion of an alignment device showing a spring leaf 170 on the bottom of the guide.
Figure 6C:
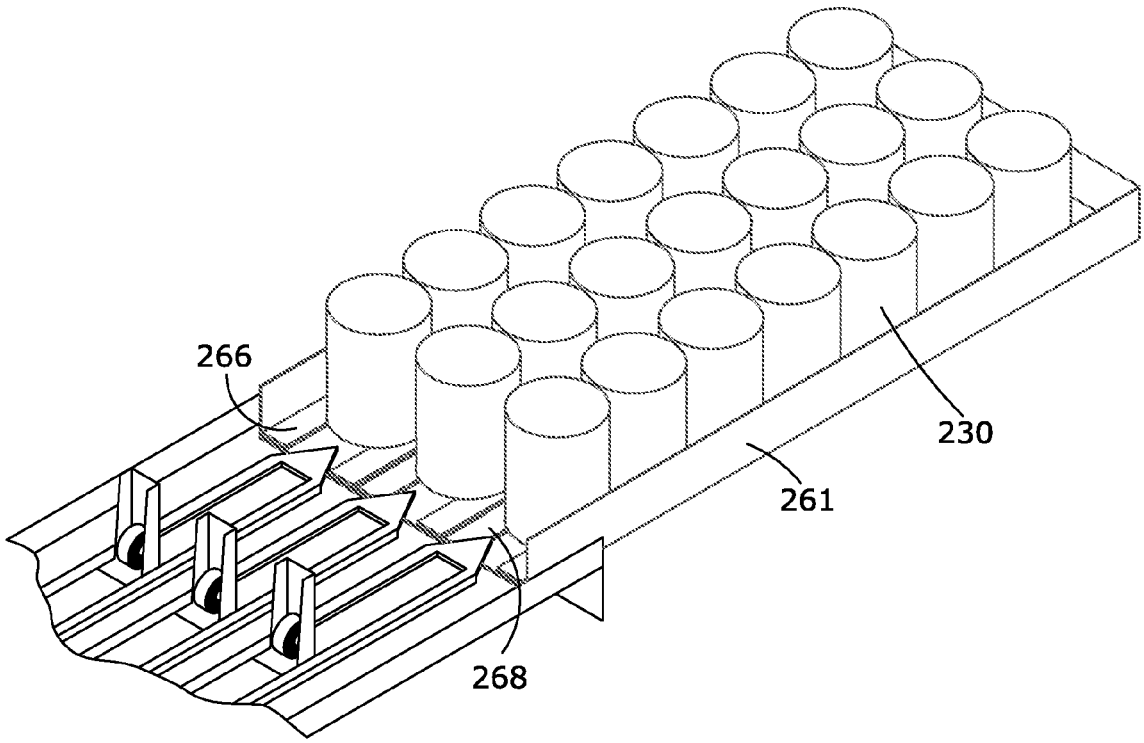
FIG. 6C shows a carton of merchandise items inserted over the alignment devices of FIG. 6A.
Figure 6D:
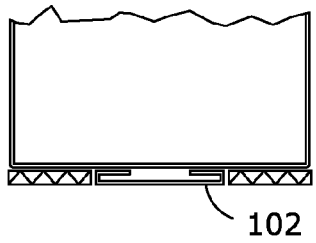
FIG. 6D shows a front view of one row of merchandise items supported on an alignment device 102.

FIG. 6A is a front perspective view of several alignment devices 102 positioned on a tray 302 which may be placed on a display shelf 300 (not shown). FIG. 6B is a side view of the front portion of an alignment device showing a spring leaf 170 on the bottom of the guide. In this example, the spring spacer keeps the front portion of the guide elevated slightly above the display shelf so that a carton can be slid onto the alignment device. In this example, it is not necessary to remove the bottom portion of the display carton because the alignment device will slide onto the bottom portion of the carton. FIG. 6C shows a carton 261 of merchandise items 230 inserted over the alignment devices of FIG. 6A. In this example, the merchandise items are supported by rails 266, 268 which may be fabricated into the carton, or which may be provided on a carton insert as described above. FIG. 6D shows a front view of one row of merchandise items supported on an alignment device 102. In this example, the merchandise items are supported by the alignment device rather than the carton support rails in order to reduce friction.

Carton Restraint

In various examples, the carton may be restrained from being pushed forward by the alignment device. Examples of carton restraint methods include tape or adhesive on the bottom portion of the carton, magnetic tape on the bottom portion of the carton, and mechanical stops such as pins or tabs inserted into the shelf.

FIG. 7A is a side view of a carton 200 where a bottom slot 209 (not shown) is removed except for the rear end of the carton. In this case, the remaining portion of the carton engages the rear of the alignment device guide, and restrains the carton from being pulled forward. FIG. 7B is a rear view of the carton and alignment device. In this case, a rear slot 207 is removed from the carton so that the carton can be pushed over the rear pull member. FIG. 7C is a side view showing the carton dropped in place over the alignment device. When the carton is empty, it may be removed by lifting it up over the alignment device, and a new carton may be positioned over the alignment device.

Carton with Rear Slot and Stop for Alignment Device

Figures 8A, 8B, 8C:
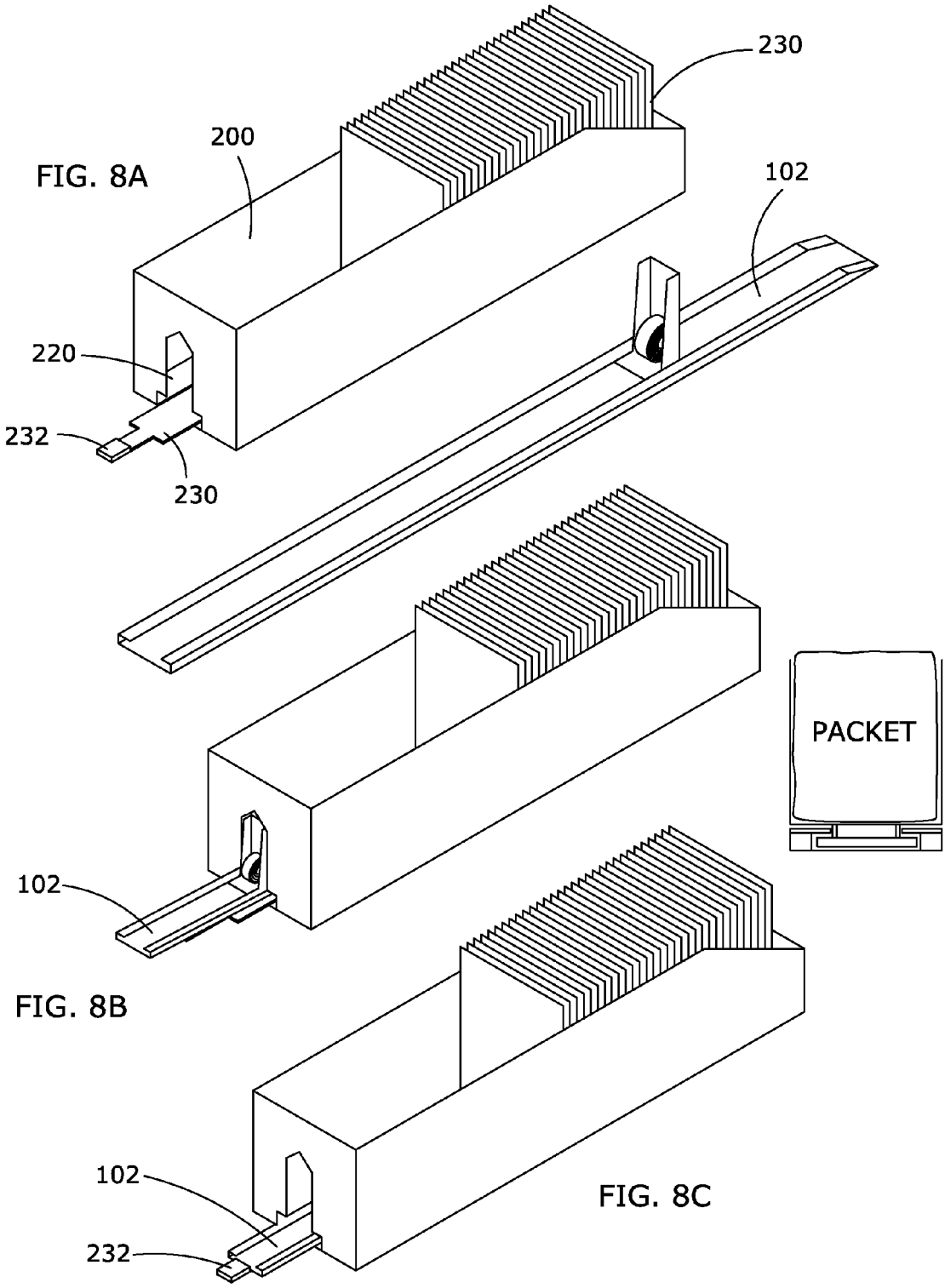
FIG. 8A is a rear perspective view of a carton 200 with support rails and a fold down rear slot 280; and an alignment device 102.
FIG. 8B shows the alignment device 102 of FIG. 8A partially inserted into the carton 200 through the rear slot 280.
FIG. 8C shows the alignment device inserted into the carton.

FIG. 8A is a rear perspective view of a carton 200 which includes support rails 220 and 221 (not shown) for supporting merchandise item pouches 280 above the carton bottom; and an alignment device 102. The carton includes a perforated fold down rear slot 280 which includes a stop block 232. FIG. 8B shows the alignment device 102 partially inserted into the carton 200 through the rear slot 280. FIG. 8C shows the alignment device inserted into the carton and held in place by the stop block 232.

Spring Alignment Mechanism with Metal Guide

FIG. 9 is a top perspective view of a metal alignment device 105 which has a front end including tapered sides and a recessed area 123 for attaching a spring hook. In other examples, the guide may be formed of a plastic or other materials.

Pull Member Stop

In this example, a stop may be provided on the guide so that the base of the rear pull member is restrained short of the front of the guide. The stop creates a space that may be used for re-inserting a merchandise item into the front of the carton. The stop is typically a bump on the guide which is created by a dab of glue or a mechanical dimple or tab.

Front Spring Anchor

In this example, the front anchor for the spring is a V-shape, which keeps the spring centered and facilitates a chisel effect as the front of the guide is slid under merchandise items. In this example, the thin metal guide may be slid under blow molded bottles and other containers with rounded edges without elevating the items.

These embodiments are examples of the invention and it is evident that those skilled in the art can make variations without departing from the inventive concepts, and the invention should be limited solely by the spirit and scope of the claims.

What is claimed is:

1. A spring driven alignment system comprising
a carton comprising
a row of merchandise items,
a substantially closed bottom,
a front,
a rear with a rear slot or opening a removable perforated section on the rear of the carton wherein the removable perforated section is capable of remaining attached to the bottom of the carton and supporting the guide when the perforated section is in an extended position,
a first side, and
a second side;
an elongated guide inserted at least partially through the rear slot or opening under the row of merchandise items and supported on the bottom of the carton, the guide comprising
a front end,
a rear end; and
a pull plate;
a spring comprising
a first end secured to the guide in proximity to the front end of the guide, and
a coiled portion positioned between the pull plate and the rear end of the guide, such that coiled portion drives the pull plate to engage the rearmost item in the carton and force the rearmost item toward the front of the carton.

2. The spring alignment mechanism of claim 1 wherein a rear portion of the guide is partially scribed, such that the guide can be bent or cut to a desired width.

3. The spring alignment mechanism of claim 1 wherein the pull plate further comprises
a first side extension; and
a second side extension.

4. The spring driven alignment system of claim 1 wherein the removable perforated section comprises a stop block.

5. The spring driven alignment system of claim 1 wherein the guide further comprises a first side rail, and
a second side rail.

* * * * *